US012564296B2

(12) United States Patent
Peter

(10) Patent No.: US 12,564,296 B2
(45) Date of Patent: Mar. 3, 2026

(54) COMPOSTING TOILET

(71) Applicant: COMPO CLOSET LTD, Poole (GB)

(72) Inventor: Richard Lewis Peter, Stafford (GB)

(73) Assignee: COMPO CLOSET LTD, Poole (GB)

( * ) Notice: Subject to any disclaimer, the term of this patent is extended or adjusted under 35 U.S.C. 154(b) by 265 days.

(21) Appl. No.: 18/281,888

(22) PCT Filed: Mar. 11, 2022

(86) PCT No.: PCT/GB2022/050645

§ 371 (c)(1),
(2) Date: Sep. 13, 2023

(87) PCT Pub. No.: WO2022/195260

PCT Pub. Date: Sep. 22, 2022

(65) Prior Publication Data

US 2024/0148199 A1 May 9, 2024

Related U.S. Application Data

(60) Provisional application No. 63/160,762, filed on Mar. 13, 2021.

(51) Int. Cl.
*A47K 11/02* (2006.01)

(52) U.S. Cl.
CPC ..... *A47K 11/02* (2013.01)

(58) Field of Classification Search
CPC ..... A47K 11/02
See application file for complete search history.

(56) References Cited

U.S. PATENT DOCUMENTS 5,276,924 A * 1/1994 Hachima ..... A47K 11/02 4/111.1
6,112,338 A * 9/2000 Sundberg ..... A47K 11/02 366/186
6,260,216 B1 * 7/2001 Lejgren ..... C05F 3/04 4/449
2016/0235262 A1 8/2016 Trott et al.
2020/0214514 A1 7/2020 Stearns et al.

FOREIGN PATENT DOCUMENTS

WO 2004008930 A1 1/2004

OTHER PUBLICATIONS

International Search Report and Written Opinion received in PCT/GB2022/050645, mailed Jun. 3, 2022, 9 pages.

* cited by examiner

*Primary Examiner* — Janie M Loeppke
(74) *Attorney, Agent, or Firm* — Meunier Carlin & Curfman LLC

(57) ABSTRACT

The present invention provides a composting toilet (1) including: a body (10), a solids collection chamber (3) for receiving faecal matter, and an agitator (30) for moving faecal matter within the solids collection chamber (3); the agitator (30) rotatably mounted about an axis X, and an agitator drive mechanism (40) for driving the agitator; wherein the agitator drive mechanism (40) comprises a handle (50), an extendable drive shaft (60) having a first end (61) and a second end (62), the first end (61) connected to the handle (50) and the second end (62) is connected to the agitator (40); and the handle (50) is moveable from a first stowed position (51) to a second in-use position (52) for driving rotation of the agitator (30).

20 Claims, 9 Drawing Sheets

COMPOSTING TOILET

FIELD

The present invention relates to composting toilets. More particularly, the present invention relates to a mechanism for agitating faecal matter in a composting toilet.

BACKGROUND

Portable toilets facilitate people to travel and stay in more remote places while maintaining a safe sanitary environment. Examples of such remote places where portable toilets can be used, include boats, RVs and cabins, where sewer plumbing is not available or practical.

Chemical toilets are an existing solution to provide sanitation in these environments. In such toilets, faeces and urine are stored in a container with chemicals to mask the smell. Some of these chemicals can be damaging to the environment and require disposal at specific disposal facilities. Such toilets require emptying every 2-3 days under normal usage and may require additional water and chemicals to be added after emptying, in order to be reused.

Portable composting dry toilets are also a solution and have been increasing in popularity due to their environmental advantage in that they do not require chemicals and the practical advantage that they do not require water.

Urine diverting toilets are a particular variety of composting toilet whereby faeces and urine are kept separate to facilitate composting. Separating the highly alkaline urine from faeces facilitates aerobic decomposition of the faeces by microbes and also reduces odours.

Urine separating toilets typically do not require addition of compost material after each use to absorb excess liquid, or energy to be expended to heat the mixture to reduce moisture content. This gives them the benefit of not requiring solids to be emptied as frequently and not requiring a supply of fresh material or large energy supply. To aid aerobic decomposition and drying of the captured faeces it is known to include an agitator to move captured faeces and allow air to circulate.

Emptying a portable toilet is not a job that is enjoyable for the user and is time consuming so simply extending the duration between such events is a benefit for users wellbeing and is time efficient. That the faecal matter from a urine diverting toilet has substantially less odour and this makes emptying a more pleasant process for the user and indeed when the toilet is in use the odour released is also reduced. A further benefit of a urine diverting toilet is the increased portability allowed by a reduced regularity of emptying and the reliance on disposal facilities required by chemical toilets. In the places and vehicles where such toilets are employed space is often at a premium so any features which cause the composting toilet to occupy a reduced space and allow easier access to collection receptacles and chambers for disposal is a benefit.

Self contained dry toilets store bodily waste until a later time that is more convenient for its disposal or treatment. During storage, the contents, in particular solid wastes, are often mixed with a dry, carbon rich material to facilitate drying, balance nitrogen-carbon ratios and trap oxygen to promote aerobic decomposition. Typical carbon-rich materials used are sawdust or coco coir.

Addition of carbon-rich material after each use requires this material to be readily available near the toilet which requires storage space due to its bulky nature. Due to the cover material's dry and often light consistency, spillage of the material while it is added to the toilet is a common occurrence. In addition to being a nuisance to clear up, this can block any plumbing or ventilation that may form part of the device.

To solve this problem, some self contained dry toilets have been created that feature an agitation mechanism. This enables the cover material to be added in a preparation phase so that the faeces can be easily covered by the cover material contained within the toilet after each use.

Various mechanisms to operate the agitation mechanism have been devised. The first and simplest of these is to fix the agitation mechanism in the base of the unit itself and attach a handle externally. This has the problem of needing to disassemble the unit to invert it and empty it, otherwise manual excavation is required. Natures Head (US2020/0214514), Air Head (US20160235262).

A second solution is to have a removable solids bin as well as a removable handle, external to the unit. This enables the solids bin to be removed to be emptied and the handle is stowed elsewhere when not in use as seen on C-Head products or BioToi. This solution requires a hole in the exterior of the unit, from which odour may escape, or otherwise necessitate seals to help contain odour.

Current designs for urine diverting toilets typically have a fixed urine collection area and an opening or aperture to the solids chamber for users to defecate through. Existing designs either leave the opening exposed, permit a removable 'modesty' cover, have a flap or a series of separate flaps. These arrangements require the user to touch the inside surfaces of the composting toilet and or do not seal well to keep odour in the toilet.

Without a removable solids chamber, a self-contained dry toilet will need to be either disassembled to invert the solids chamber or have material manually evacuated from above, perhaps by means of a trowel. Removal of an internal container without the means for agitating its contents is disclosed in WO2004008930A1. However, when the container features the means to agitate its contents, both a drive mechanism and engagement mechanism for the drive mechanism are required.

Accordingly the current invention provides a composting toilet with a removable container featuring an agitation mechanism without the requirement to remove, stow, retrieve and replace a handle between uses, or add a power supply to drive a motor. This is particularly important for portable applications such as when camping or travelling. In portable applications, the toilet is often moved and the handle may be lost. It is also more convenient for situations where space is limited or where inserting a separate handle is difficult, especially for the elderly or less physically able.

SUMMARY OF THE INVENTION

The inventor recognized that there are a number of drawbacks with the current systems. According to a first aspect, there is provided a composting toilet including: a body a solids collection chamber for receiving faecal matter, and an agitator for moving faecal matter within the solids collection chamber; the agitator rotatably mounted about an axis X, and an agitator drive mechanism for driving the agitator. Wherein the agitator drive mechanism comprises a handle, an extendable drive shaft having a first end and a second end, the first end connected to the handle and the second end is connected to the agitator; and the handle is moveable from a first stowed position to a second in-use position for driving rotation of the agitator.

The movable handle advantageously allowing a smaller composting toilet than the designs of the prior art.

Preferably, wherein the extendable drive shaft comprises an inner shaft connected to the handle slidably engaged in an outer shaft connected to the agitator and a shaft engagement means for transmitting rotation from the inner shaft to the outer shaft.

Preferably, wherein the shaft engagement means comprises a longitudinal slot in the outer shaft and a pin extending through said slot and secured to the inner shaft or the shaft engagement means comprising inner shaft and outer shaft having a non-circular complementary cross-section, or a detent ball.

Preferably, wherein the solids collection chamber is a removable solids collection chamber and the agitator drive mechanism comprises an agitator engagement means for engagement and disengagement of the agitator from the agitator drive mechanism when the solids collection container is removed and transmitting drive from the agitator drive mechanism to the agitator.

The engagement means advantageously allowing the solids collection chamber to be removed from the body separate from the agitator drive mechanism allowing the drive mechanism to be more securely located in the body using fewer simpler components. Importantly for a composting toilet having a fluids receptacle and a solids collection chamber the two may be removed and emptied independently.

Preferably, wherein the agitator engagement means includes one or more shaft drive surfaces on the drive shaft for engaging one or more agitator drive surfaces on the agitator.

Preferably, wherein the one more shaft drive surfaces of the engagement means include a radially extending tongue fixed to the drive shaft and the one or more agitator drive surfaces comprise a slotted disc attached to the agitator defining an elongate slot and wherein, the tongue engages the slotted disc when the solids collection chamber is installed in the body.

The tongue and slot arrangement advantageously providing a linear engagement path to allow simple alignment and engagement of the drive shaft and agitator at the engagement means.

Preferably, wherein the agitator drive mechanism includes an alignment means for aligning the one or more agitator drive surfaces and the one or more shaft drive surfaces to allow engagement and disengagement of the engagement means on fitting and removal of the solids collection chamber.

The alignment means advantageously allowing the drive mechanism to engage and disengage from the agitator when the solids collection chamber is installed and removed.

Preferably, wherein the alignment means includes a drive mechanism alignment means comprising the agitator drive mechanism with one or more handle aligning surfaces and the body including one or more complementary body aligning surfaces for receiving the handle in one or more aligned positions when in the first stowed position.

Therefore, when the handle is in the stowed position the agitator drive mechanism and the agitator default to one or more aligned positions suitable for engagement and disengagement of the engagement means when the solids collection chamber to be removed.

Preferably, wherein the handle aligning surfaces are on the handle and the one or more complementary body aligning surfaces comprise a recess for receiving the handle when in the first stowed position.

The recess advantageously providing both the alignment means and further reducing the volume or space needed by the composting toilet.

Preferably, wherein the body includes a front end toward which urine is received and a back end toward which faecal matter is received and wherein the handle is located at the front end of the body. When used as a toilet when installed in for example a vehicle, access to the front face of the composting toilet is required by the user. Therefore, by siting the handle on the front face of the composting toilet the toilet can be installed with only a single side accessible further reducing the space required by the composting toilet.

Preferably, the alignment means includes an agitator alignment means. Preferably, wherein agitator alignment means comprises the agitator having a centre of gravity G displaced radially from axis X, and wherein the one or more agitator drive surfaces are orientated to engage with the drive shaft drive surfaces when the centre of gravity G is below the axis X at the point of engagement.

Therefore, when the solids collection chamber is empty and thus free from obstructions and leaving the agitator free to rotate, the agitator alignment means will align the agitator alignment surfaces, ready for insertion of the solids collection chamber into the body without interaction from the user.

Preferably, wherein the elongate slot of the slotted is parallel to a line extending between axis X and the centre of gravity G of the agitator. Therefore, advantageously aligning the slot with the direction of movement M of the solids collection chamber when inserted or removed vertically as in the preferred embodiment.

Preferably, wherein the body includes a first drive shaft support at the front end for supporting the first end of the extendable drive shaft and a second drive shaft support proximal the solids collection chamber within the body and wherein the first end is rotatably mounted within said first drive shaft support and the second end of the extendable drive shaft is rotatably mounted in the second drive shaft support.

Preferably, the composting toilet including a removable fluids receptacle for receiving urine, within said body and said fluids receptacle including a drive shaft clearance slot for allowing easy removal of the fluid collection container.

Preferably, wherein the agitator includes one or more tines extending radially from axis X in an arc of angle $\alpha$ less than 180 degrees from axis X and optionally an arc less than 90 degrees from axis X for providing clearance to a user when the composting toilet is in use. This tine arrangement advantageously provides the dual benefit of providing the desirable offset centre of gravity of the agitator for the agitator alignment means and increased clearance between the user and the agitator when the composting toilet is in use. Reducing the likelihood of user contact with faecal matter.

Preferably, the composting toilet including one or more fans for moving oxygenated air around the faecal matter within the solids collection container. Thereby improving the speed of decomposition.

Preferably, the composting toilet including an aperture in the body fluidly connected to the one or more fans.

Preferably, wherein the aperture includes an air filter optionally wherein said air filter is an odour reducing filter.

Preferably, wherein the solids collection chamber has an open top and a closed bottom for containing faecal matter and handles, indentations or grips in the bottom half so as to facilitate easier emptying of the chamber when inverted.

Thus the invention advantageously provides a compositing toilet with a removable solids collection container that includes an agitator removable therewith. The agitator means any cover material if used can be added to the solids collection container in a preparation step and mixed after each use. This removes the need to maintain a store of bulky cover material near the toilet and eliminates the risk of spillage when adding it. When emptying no disassembly of the composting toilet or collection container is required. When the agitator forms part of the base, the toilet must be disassembled to invert the bin. Alternatively the base must be manually excavated. With a composting toilet of the current invention, the bin can be removed for ease of emptying and can be easily inverted to prevent manually excavating contents.

The handle is stowed with the unit, eliminating the need for additional storage. It is also quicker and easier for the user to retract an extending handle than to locate and insert a separate handle. The proposed solution does not leave a hole in the exterior of the unit when the handle is removed, from which odour may escape that requires seals or gaskets to close the opening or seal it off.

The current invention advantageously requires no additional power and the simple mechanical design reduces cost and complexity requiring reduced repair and maintenance in remote locations.

The inventor recognized that because the conventional urine separating toilet does not have a cover to the solids chamber, faecal odour is more likely to leave the solids chamber. Furthermore, urine that does not fall into the collection area may enter the solids chamber and impair composting.

Accordingly aspects and/or embodiments seek to provide apparatus for limiting odour from a composting toilet.

The inventor recognized that the use of flaps and covers described in the prior art, restricts the configurations of more compact designs due to the need for the flaps to rotate or slide. This imposes a restriction on the size of the flap and therefore compromises the size of the aperture to the solids chamber for the user.

The inventor also recognized that these urine diverting toilets are typically waterless and so any faecal residue due to faeces contacting the aperture must be manually cleaned. Based on these recognitions, the inventor recognized that there exists a need for a novel design for a urine diverting toilet that addresses these limitations of current designs.

The present invention comprises a novel toilet design comprising an upper and lower section. The upper section comprises a urine collection area and a pair of rotating plates which can be positioned to conceal or reveal an aperture for defecation. The surface encourages urine to flow towards the collection area and reduces the flow of airborne odour from the solids chamber to the user.

BRIEF DESCRIPTION OF THE DRAWINGS

Embodiments will now be described, by way of example only and with reference to the accompanying drawings having like-reference numerals, in which.

DETAILED DESCRIPTION

The present invention relates to a novel configuration for urine separating composting toilets. More precisely, embodiments describe permits the separation of urine and faeces while ensuring a larger aperture for defecating into the solids chamber for easier use and to minimise the need for cleaning.

A Urine Diverting Dry Toilet (UDDT) according to an embodiment comprises an upper section and a lower section. The upper section facilitates the separation of urine from faeces. Typically the upper section will permit the addition of, or incorporate an area for, the toilet user to sit while using the toilet. The upper section comprises a faecal aperture for the user to defecate through and a urine aperture or spout to facilitate diversion of urine to separate it from faeces.

The lower section of a UDDT comprises various apparatus to handle the solid and liquid excrement. These typically include a chamber to collect solids with at least a portion of said chamber typically located below the faecal aperture. They also typically include either a bottle to store collected urine until it can be disposed of, or appropriate plumbing to separate it from the solid faeces to be dealt with separately.

The solids and liquids apparatus of the lower section can constitute the body 10 or the supporting structure 10 of the toilet itself or be separate from the body 10. Separating this apparatus from the body 10 has the desirable benefit of potentially eliminating the need to disassemble the unit for the removal of any stored excrement.

Figure 1:
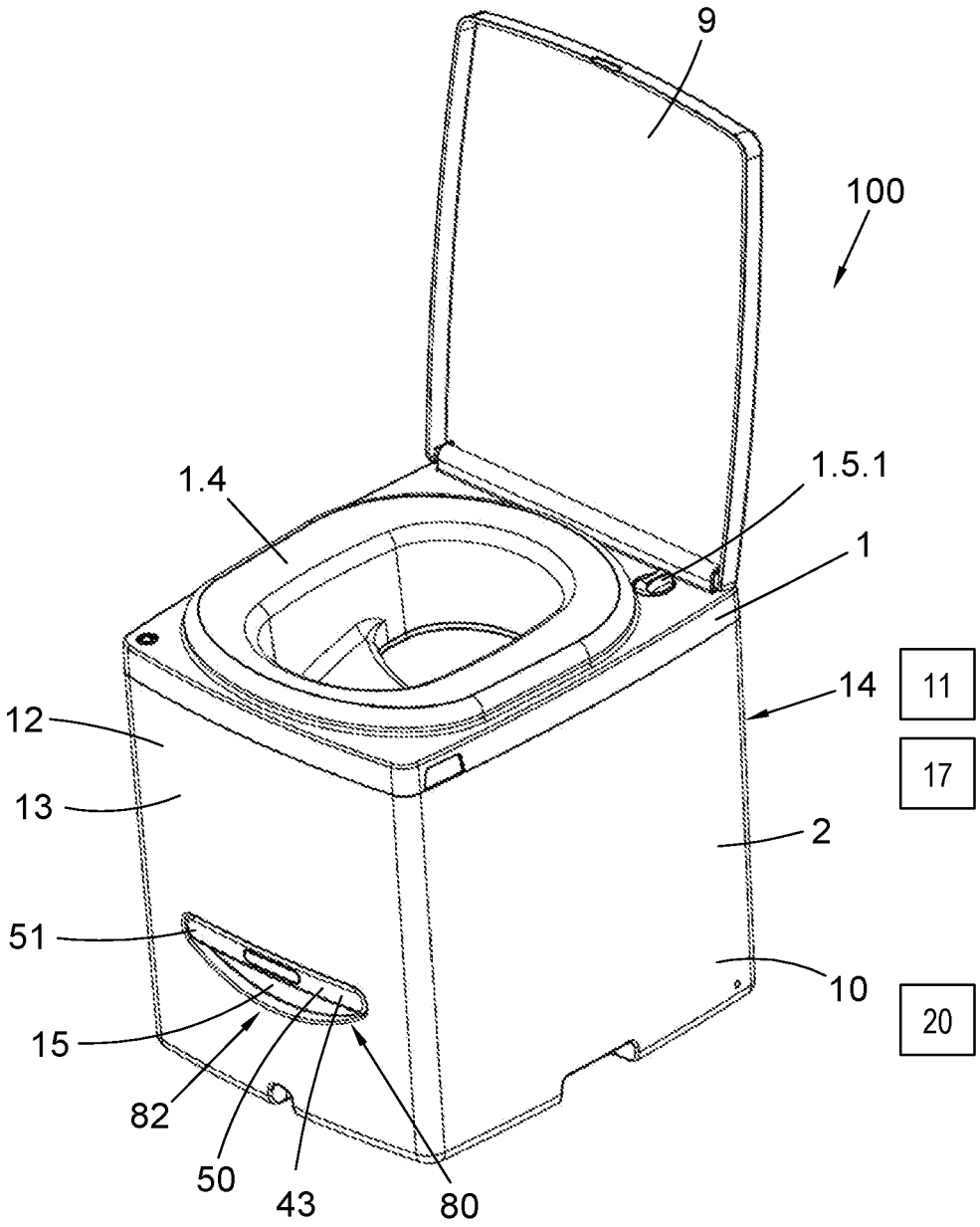
FIG. 1 shows a composting toilet according to the current invention.

FIG. 1 depicts a view of the outside of a composting toilet 100 according to the current invention with the lid 9 in the raised position. The seat 1.4 can be seen exposed on the upper section 1 of the body 10. The handle 50 is showed in a first stowed position 51. The body 10 has a front end 12 with a front face 13 and a back end 14. The front end 12 is the end toward which urine is received and the back end 14 is the end toward which faecal matter is received.

Figure 2:
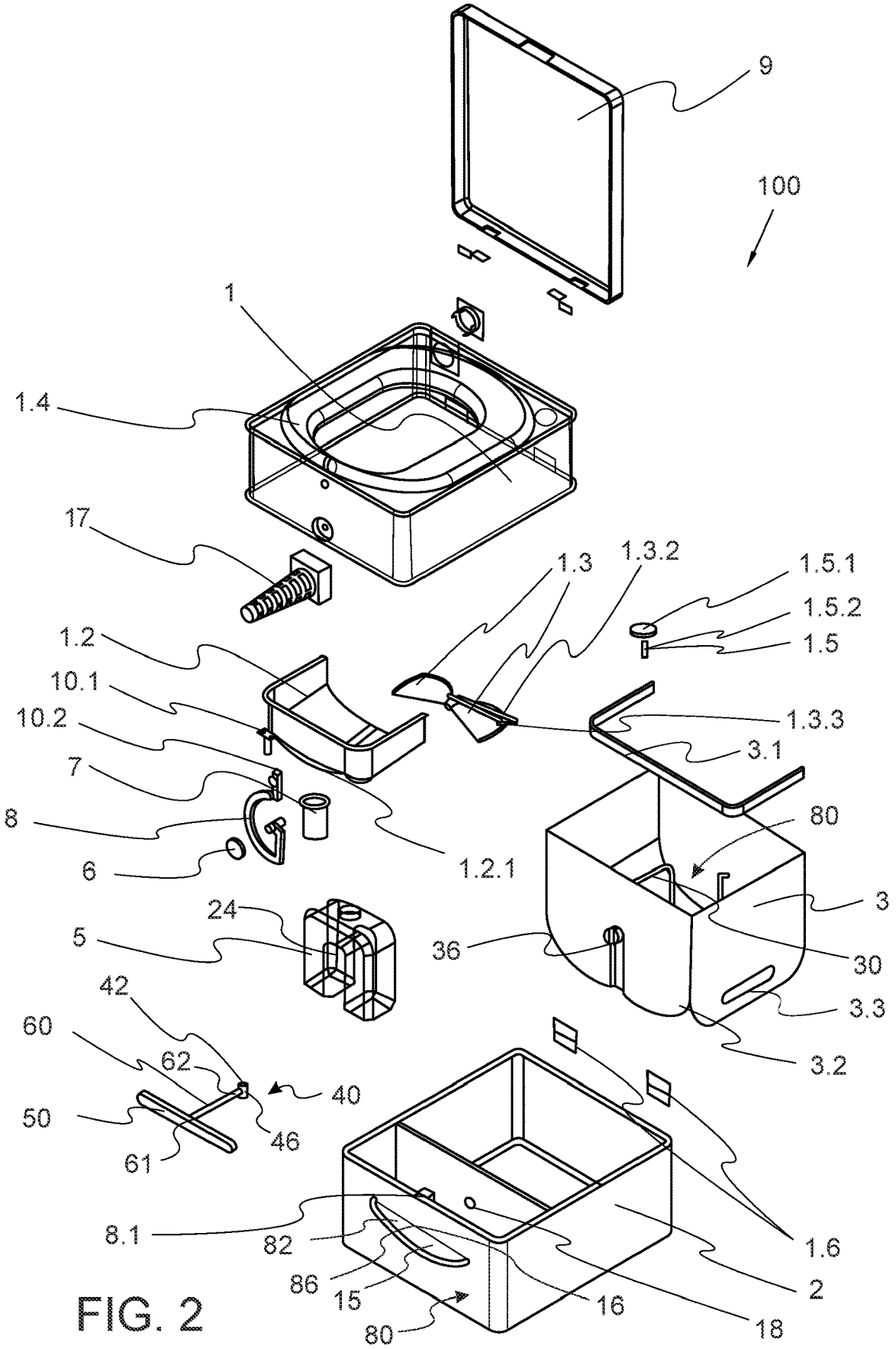
FIG. 2 shows an exploded isometric view of a urine diverting toilet with rotating plates.

A first aspect of the current invention will be described with reference to FIG. 2. FIG. 2 shows a cross-sectional exploded perspective view of a preferred embodiment of the toilet 100. The toilet 100 includes a body 10 with an upper section 1 including a seat area 1.4, overlying a solids chamber 3 contained within the body 10, which itself overlies the lower structure 2 of the toilet 100. A liquid receptacle 5, also within the body 10 receives the liquids waste, and both the solids chamber 3 and liquid receptacle 5 are separate from the lower structure 2 of the toilet to allow for removal of said solids chamber 3 and liquid receptacle 5 for disposal of their contents. it will be understood that the liquids chamber is optional and liquids may be drained directly to an external location.

The upper and lower sections 1, 2 can be joined together by any appropriate means such as but not limited to hooks, hinges, clips, magnets, latches, bolts screws or any combination thereof. In the preferred embodiments depicted in the figures the rear of the toilet 14 is attached with hinges 1.6. The front of the toilet 12 uses a knob 6 located in the upper section 1, which turns a hook 8 which engages a boss 8.1 on the lower section 2, thereby securing the upper section 1 and lower section 2 in a way that makes it easy to separate and secure these sections. This is not intended to limit the scope of the application however and anyone skilled in the art will devise similar mechanisms to secure the two units appropriately.

Figure 6:
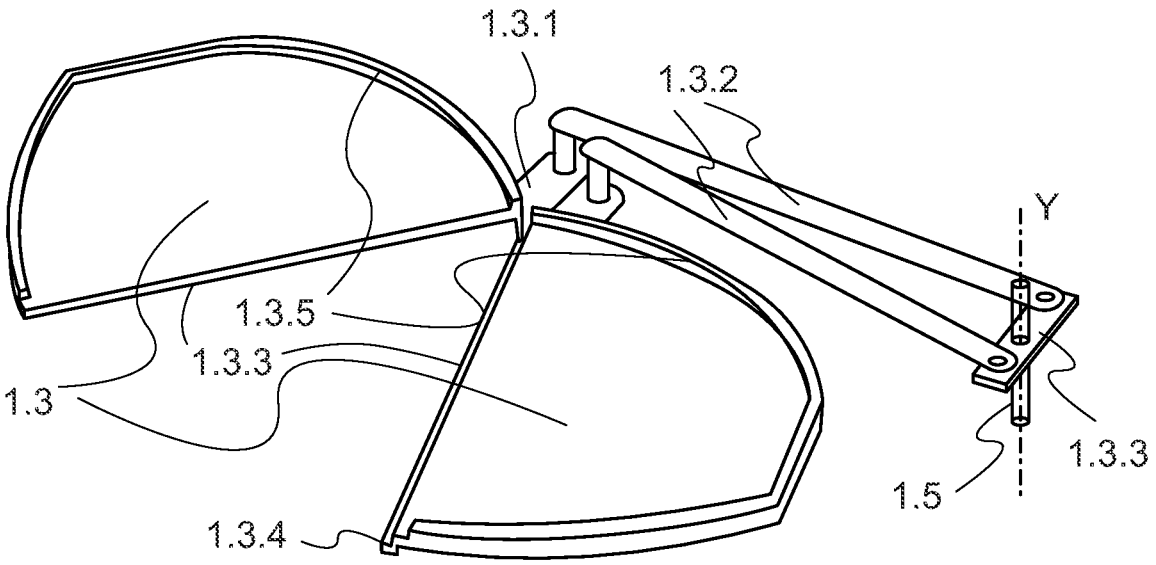
FIG. 6 shows a View of mechanism to operate rotating plates.

The upper section 1 of the toilet 100 comprises a fixed urine collection area 1.2 to divert urine through a urine aperture 1.2.1 in the lower portion thereof allowing the urine to pass into the lower structure 2 of the toilet. Rotating plates 1.3, shown in FIG. 6, are rotated to different positions, one of which reveals a faecal aperture for defecation into the solids chamber 3, and the other position which covers the solid collection chamber 3.

Figure 3:
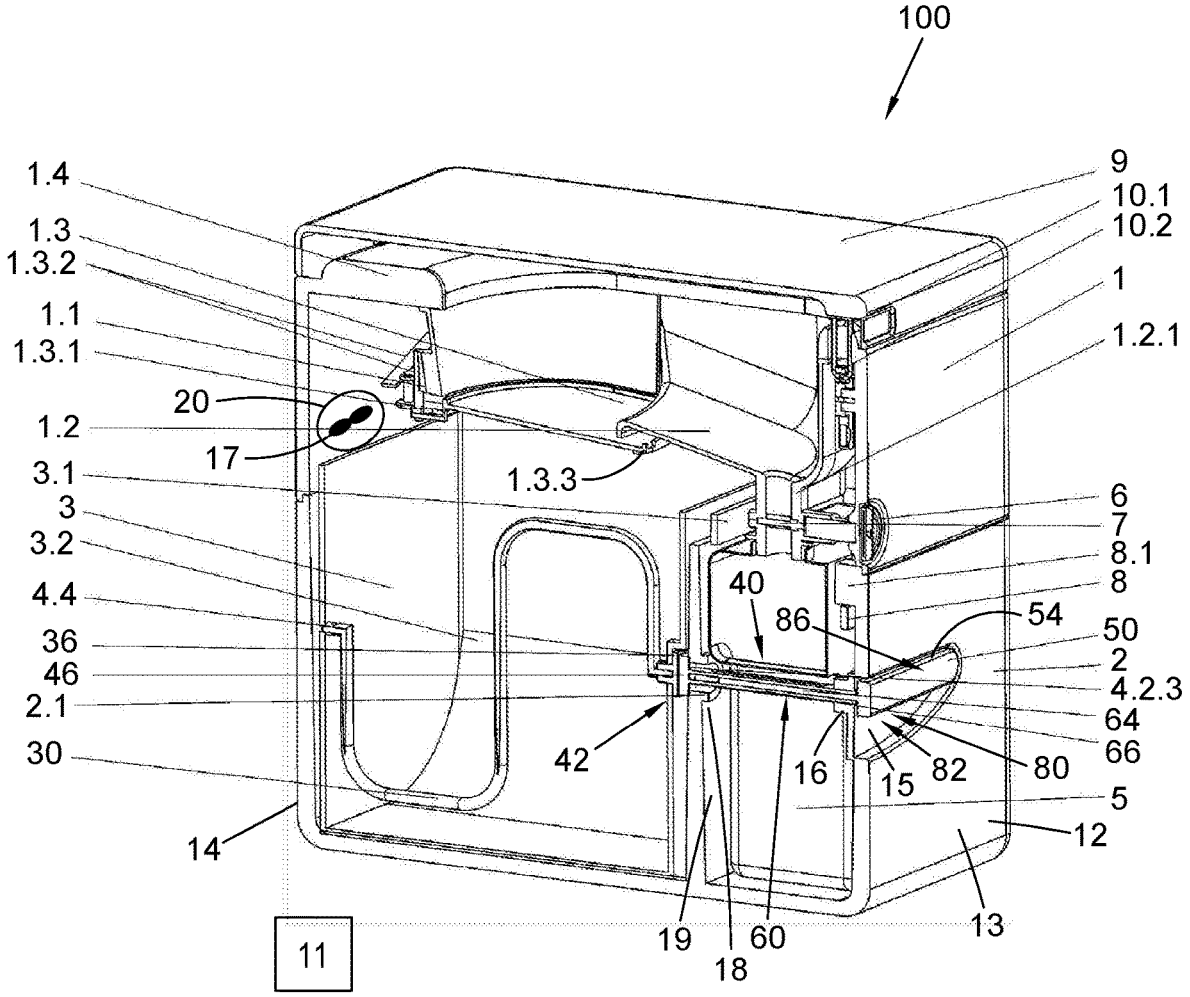
FIG. 3 shows a central cross-section perspective view of a preferred embodiment, showing a cross section of surfaces of the rotating plates with appropriate lips to minimise escape of urine, a fixed urine collection area, the Lower body with removable solids bin, the handle and the fluids collection receptacle.

The fixed urine collection area 1.2 can be attached to the upper section by an appropriate means or be formed as part of the upper section. The rotating plates 1.3 are attached to the upper body in such a manner that they can rotate on either concentric axes or separate axes. This can be achieved as shown in the preferred embodiment, by rotating around concentric axes supported by a structure 1.1 shown in FIG. 3, which attached to, or forming part of, the upper structure of the toilet 100. If attached to the upper structure 1, the housing structure 1.1 can be attached by any appropriate method including but not limited to gluing, screwing, welding, bolting, riveting, clipping or any other appropriate means.

In one embodiment, the two rotating plates 1.3 have matching edges 1.3.3, either straight or other shape, that match in a way to minimize gaps between the plates in the 'closed' position. The matching edge can feature an overlap 1.3.4 to further reduce the passage of liquids or odours between the plates The rotating plates 1.3 may be angled so as to divert urine towards a specific area for separate collection. They may also feature appropriate lips 1.3.5 to guide any flow of liquid toward the specific liquid collection area 1.2 for collection. This could be into a separate container 5, into the fixed urine collection area 1.2 or separate pathway 5*a* for storage or drainage. In a preferred embodiment, the slope and contours of the rotating plates direct liquids into a catchment area that subsequently drains into the urine bottle 5. This can drain either by either a channel in the urine collection area 1.2, or in the preferred embodiment a separate tube (not shown) connected to the fixed urine collection area 1.2.

The rotating plates 1.3 may be operated by any means including but not limited to rods, knobs, cams, arms, gears, shafts or levers or any combination thereof.

In a preferred embodiment depicted in FIG. 6, the plates 1.3 are operated by rods 1.3.2 acting upon arms 1.3.1 that extend from the plates. The rods 1.3.2 can be secured with either bends in the rods, such as 'z' bends or other fixtures including but not limited to studs, holes, rivets screws clips or other appropriate common fixtures, or any combination thereof. These rods 1.3.2 are in turn similarly connected to a bar 1.3.3 that is in turn connected to a shaft 1.5 that extends to the perimeter of the outer structure 1 of the toilet to be rotated by the user. Shaft 1.5 is free to rotate around its central axis Y and may feature any additional furniture such as knobs 1.5.1 or levers to improve the aesthetics and or ergonomics for the user. This depiction is for illustration of a single method for operating the two plates and is not intended to limit the scope of the invention. A person skilled in the art will be able to devise other mechanisms to operate the 2 plates in the manner required for successful operation of the toilet.

The structure of the upper body 1 may incorporate the addition of a seat 1.4 to improve the comfort of the user or incorporate such a seat 1.4 within its structure as depicted in the preferred embodiment.

The solids chamber 3 is preferably positioned with at least a portion of the chamber 3 below the faecal aperture of the upper section 1. In preferred embodiments, the solids chamber 3 is separate from the structure of the lower section 2 to facilitate removal for easy emptying without needing to separate the upper 1 and lower 2 sections, as is the case with some prior art toilets.

Figure 8:
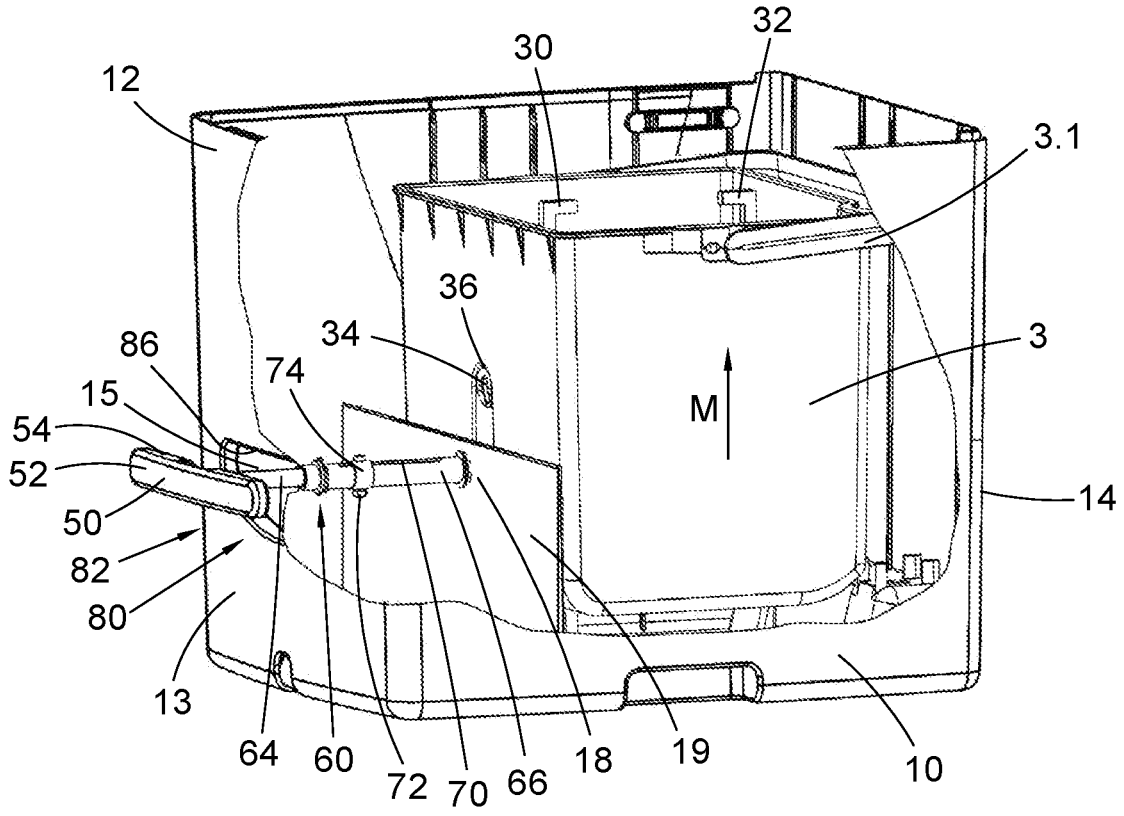
FIG. 8 shows a cut away view of the body with the solids collection chamber displaced vertically from its installed position, partially removed.
Figure 10:
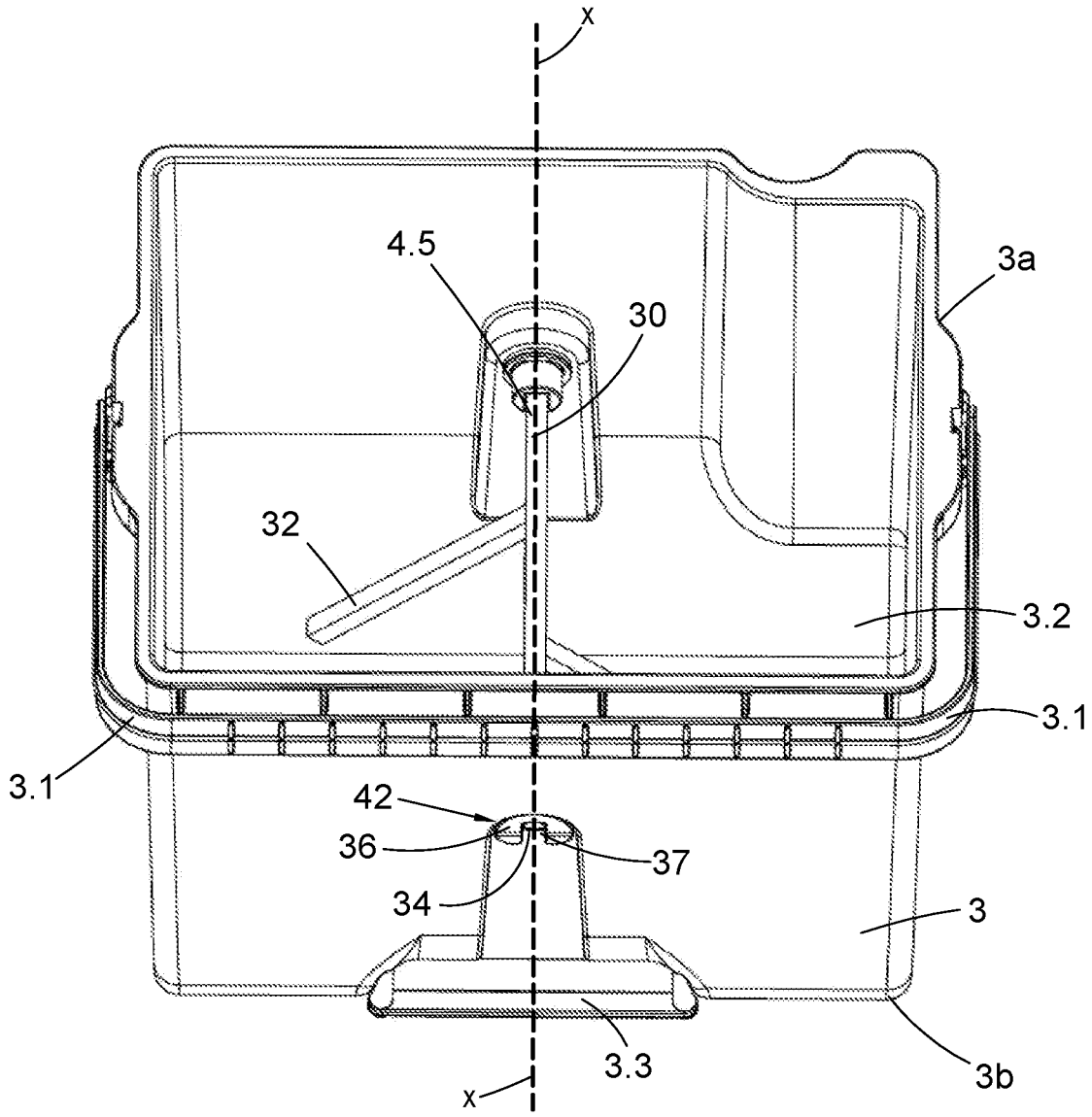
FIG. 10 shows the base of the solids collection chamber.

In preferred embodiments such as that shown in the figures, for example in FIG. 2 and FIG. 8, the solids chamber 3 can feature a handle 3.1 to facilitate removal and transportation of the chamber in an upright position. The solids collection chamber in the preferred embodiments shown is removed vertically in direction M and is shown in FIG. 8 partially displaced. As shown in FIG. 10 the solids collection container includes a top 3*a* and a bottom 3*b* and may also feature handles, indentations or grips 3.3 in the bottom half of the solids collection chamber 3 so as to facilitate easier emptying of the chamber 3 when inverted or otherwise.

It will be understood that the solids collection chamber 3 could be removed horizontally with suitable amendments to the body 10 and other features described below.

Additionally, the solids chamber 3 may incorporate an agitator 30 to agitate solids within it. Such agitation may introduce additional oxygen within the contents, thereby accelerating their decomposition. To facilitate agitation, the solids chamber 3 may feature appropriate shaping or contouring 3.2 to direct contents towards the agitator 30. The agitator 30 is rotatably mounted in the solids collection container 3 and may be rotatable about an axis X by an agitator drive mechanism 40. The agitator drive mechanism 40 preferably includes a handle 50 attached to a drive shaft 60. The drive shaft 60 having a first end 61 connected to the handle 50 and a second end 62 connected to the agitator 30. In a preferred embodiment the drive shaft 60 is rotatably about the same axis X as the agitator 30. However, it will be understood that the drive shaft 60 may be at an angle to axis X if required.

As depicted in FIG. 1 the body 10 may include a recess 15 for receiving the handle 50. The handle 50 can be seen located within the recess 15 in the first stowed position 51. A composting toilet 100 according to the current invention is likely to be installed where space and or access is limited. Thus, whilst the handle 50 can be located on any face of the body 10 in the preferred embodiment shown in the figures the handle 50 and thus the recess 15 are located on the front face 13 of the body 10. Therefore, access is only required to one face of the composting toilet 100 when installed.

The agitator 30 can be rotatably secured within the bin 3 by any agitator securing means 38 including but not limited to clips, circlips, screws pins, bearings of any kind or any combination thereof. In the preferred embodiment a pin passes through holes 4.4 the agitator shaft 4.5. Similar to the agitator 30, the agitator drive shaft 60 can be secured to the body by any such similar means. Where necessary, additional support can be provided to the agitator or shaft by an appropriate means including but not limited to brackets, bosses or walls or any combination thereof. In the preferred embodiments shown the agitator drive shaft 60 is rotatably mounted in a first support 16 on the body 10 with additional support provided to the agitator drive shaft 60 by a second support 18 within the body 10 proximal the solids collection chamber 3. Wherein the first support is for supporting the first end 51 of the drive shaft 60 and the second support 18 is for supporting the second end 52 of the drive shaft 60. The second support 18 may be provided by internal walls 19 of the body 10. The supports 16, 18 may include bushings or bearings to facilitate rotation of the agitator drive mechanism 40

Figure 4:
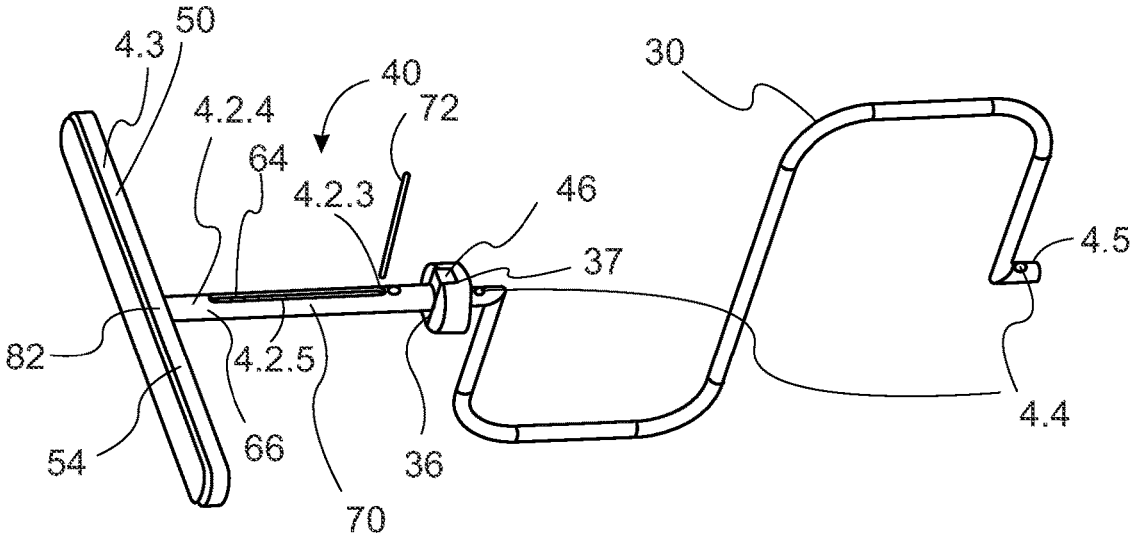
FIG. 4 shows a preferred mechanism for engagement and disengagement of the agitator and the agitator drive mechanism incorporating an extending handle and an engagement mechanism including a slotted disc and tongue.

The agitator drive mechanism 40 can be operated manually by users through the means of an appropriate handle 50 protruding from the body 10 and attached to said agitator drive mechanism 40 see FIG. 4. For embodiments where the solids chamber 3 and agitator 30 are removable from the lower structure 2, an agitator engagement means 42 is provided for engaging and disengaging the agitator drive mechanism 40 from the agitator 30 when the solids collection chamber 5 is removed and installed.

Figure 5:
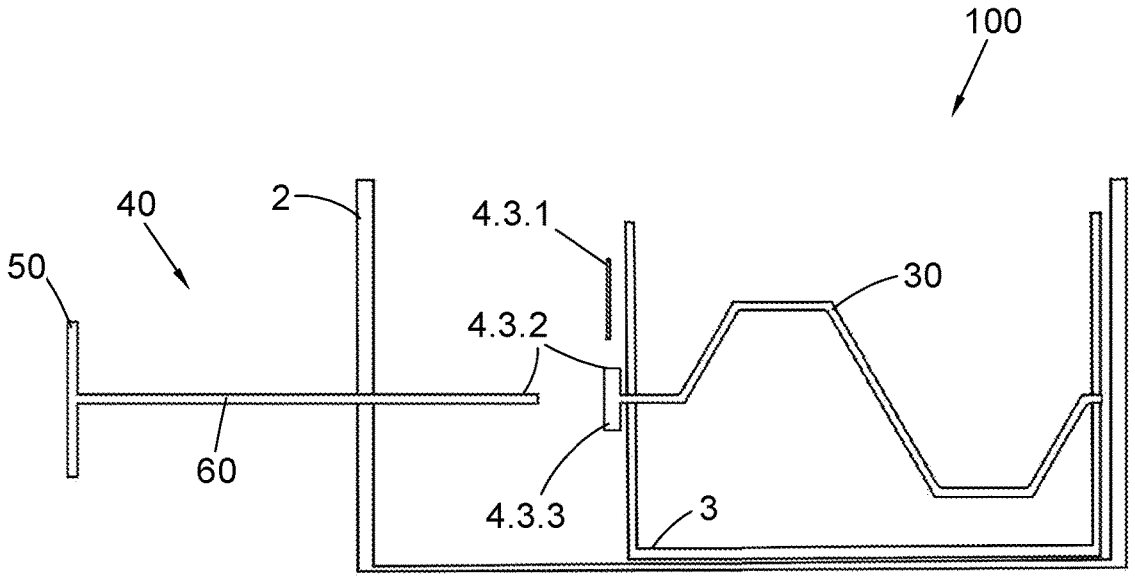
FIG. 5 shows a Cross-section of alternative mechanism for engagement and disengagement of the fixed handle using a pin.

In its simplest form the engagement means 42 includes a simple mechanism such as a pin 4.3.1 passing through holes 4.3.2 to engage an agitator shaft section 4.3.3 to the agitator 30 as shown in FIG. 5 is another example.

In a preferred embodiment shown In FIGS. 2 to 4 and 6 to 9 the agitator engagement means 42 includes one or more shaft drive surfaces 44 located on the drive shaft 60 and one or more agitator drive surfaces 34 on the agitator 30. The agitator drive surfaces 34 are complementary to the shaft drive surfaces 44 for allowing transmission of rotation from the drive shaft 60 to the agitator 30. Preferably the agitator drive surfaces 34 and the shaft drive surfaces 44 are orientated to allow one to slidably engage the other in the direction M of removal of the solids collection container 5.

In a preferred embodiment the agitator engagement means 42 includes a tongue 46 positioned to engage a groove or slot 37 in a disc 36. A tongue 46 may be an elongate protrusion extending radially from the central axis X complementary to the shape of the elongate grove or slot 37 in the slotted disc 36. It is preferable that the slot 37 in the disc 36 is open at at least one end to allow the tongue 46 to engage and disengage the slot 37 when the solids chamber 5 is removed and installed. With said preferred arrangement the solids chamber 5 can be removed when the slot is orientated in the direction required for example the direction of movement M of the solids collection chamber 5 when removed and installed.

Thus, the agitator drive mechanism 40 includes an alignment means 80 to ensure that the engagement means 42 is in alignment and thus free to engage and disengage when the solids collection chamber 5 is removed and installed or fitted. The alignment means 80 ensures that the agitator drive surfaces 34 are in a position to engage the shaft drive surfaces 44 and vice versa when required, for example when the solids collection chamber 3 is installed or removed. The alignment means 80 can be seen in FIGS. 3, 7 and 8 and comprises a drive mechanism alignment means 82 and an agitator alignment means 84.

The drive mechanism alignment means 82 includes one or more handle aligning surfaces 54 and the body 10 including one or more complementary body aligning surfaces 86 located to receive the handle aligning surfaces 54 in one or more aligned positions when in the first stowed position 51. Wherein the handle aligning surfaces 54 may be on the handle 50 or on the drive shaft 60, including the inner drive shaft 64 or outer drive shaft 66. The body aligning surfaces 54 may be on the body 10 including the front face 13, the second support 18 and may be included in a recess for receiving the handle 50 in one or more positions that align the engagement means 42.

Figure 7:
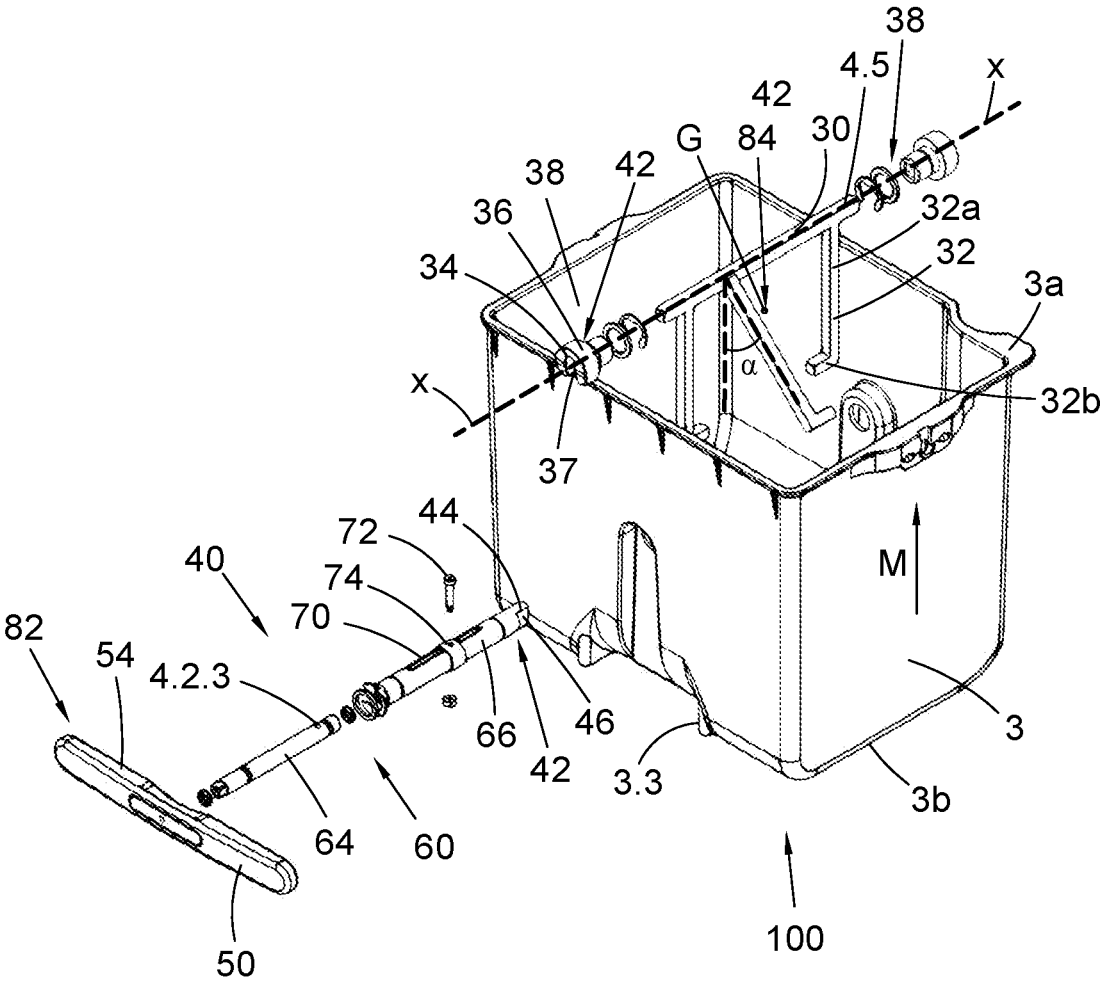
FIG. 7 shows an exploded view of the solids collection chamber with an agitator and the agitator drive mechanism according to the current invention.

The agitator alignment means 84 is provided by the geometry and installation of the agitator 30. The agitator 30 is free to rotate about axis X when not connected to the agitator drive mechanism 40. The agitator alignment means 84 is provided by the centre of gravity of the agitator 30 which may be offset radially from the axis X. Wherein, the one or more agitator drive surfaces 36 are orientated to engage with the drive shaft drive surfaces 44 when the centre of gravity G is below the axis X at the point of engagement. The drive shaft surfaces 44 and the agitator drive surfaces 36 are preferably aligned with the direction M in which the solids collection container moves when being installed or removed. The agitator 30 is free to rotate in the solids collection chamber 3 within the agitator securing means 38. Thus when empty the centre of gravity G will rest below the axis X. In FIGS. 7 and 8 where the solids collection container 3 is removed in vertical direction M it can be seen that the elongate slot 37 of the slotted disc 36 is parallel to a line extending between axis X and the centre of gravity G of the agitator 30.

Figure 9:
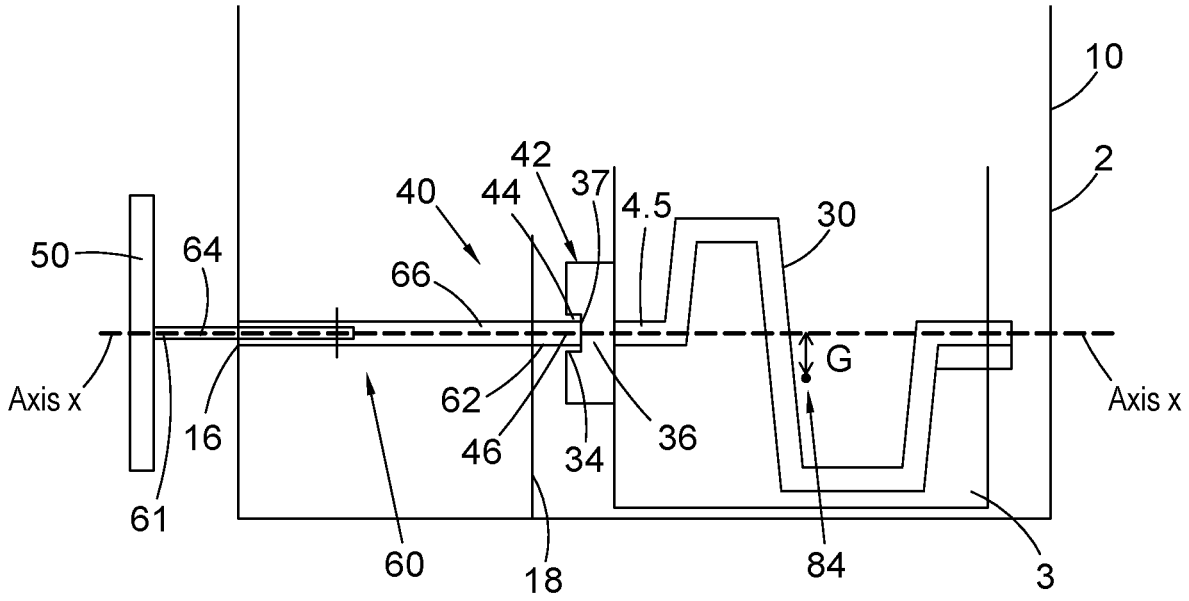
FIG. 9 shows a schematic of the extendable handle and the agitator drive mechanism connected to the agitator in the solids collection chamber.

It will be understood that in an alternative embodiment the drive shaft 60 may comprise a slotted disc 36 and the agitator 30 may comprise a tongue 46. In embodiments where the direction M is horizontal the orientation of the drive surfaces 44, 34 may be perpendicular to a line extending between axis X and the centre of gravity G of the agitator 30 and therefore still parallel with the direction M. Such an arrangement is shown in FIG. 9.

The agitator 30 as can be seen in FIG. 7 includes an agitator shaft 4.5 extending at least partially along axis X and one or more tines 32 extending radially from the agitator shaft 4.5 and/or axis X. Said tines 32 may include an elongate radially extending portion 32*a* and an axially extending portion 32*b*. The axially extending portion 32*b* preferably extends in one direction only but may extend in one or more axial directions. In the preferred embodiment the axially extending portion 32*b* is shorter than the radially extending portion 32*a*. The tines 32 may extend within an arc having an angle $\alpha$ extending from axis X. Angle $\alpha$ is less than 180 degrees and preferably is less than 90 degrees. This provides the benefit of the centre of gravity offset from the axis X. It will be understood that alternative options are possible such as displayed in FIG. 9 where the agitator comprises a bent agitator shaft 4.5 wherein the centre of gravity is offset from the axis X by the shaft 4.5 having an asymmetric geometry.

In many instances such as RVs, boats and cabins, the toilet will be used in confined spaces or stored away when not in use. In such cases it is beneficial to permit the handle 50 to extend from the body of the toilet by means of an appropriate mechanism. Referring to FIG. 4 and FIG. 8 a preferred embodiment will now be described. Depicted in FIG. 4 and FIG. 8 is an agitator 30 rotatable about an axis X and an agitator drive mechanism 40 for rotating said actuator 30. The agitator drive mechanism 40 includes a handle 50 connected to an extendable drive shaft 60 having a first end 61 and a second end 62. The handle 50 is connected to the drive shaft 60 at the first end 61 and the second end 62 is connected to the agitator 30 for allowing the handle to drive rotation of the actuator 40. The handle 50 is movable from a first stowed position 51 to a second in use position 52.

The extendable drive shaft 60 may include an inner shaft 64 slidably engaged within an outer shaft 66. The inner shaft 64 is connected to the handle and the outer shaft 64 is connected to the agitator 30. The extendable drive shaft further includes a shaft engagement means 68 for transmitting rotation between the inner shaft 64 and the outer shaft 66.

It will be understood that the inner shaft 64 and outer shaft 66 may be connected in an alternate arrangement to the agitator 30 and handle 50 respectively.

In a preferred embodiment the shaft engagement means 68 may be a pin 72 secured to the inner shaft 64 extending through a longitudinal slot 70 in the outer shaft 66. The shaft engagement means 68 may further include the pin 72 passing through a hole 4.2.3 in the inner shaft 64 and engaging the longitudinal slot 70 in the outer shaft 66. The pin 72 may also pass through a support collar 74 that partially or fully surrounds the support tube 3 and helps prevent deformation of the support tube 3 under high torque situations. Though the person skilled in the art will understand other appropriate arrangements of extendable drive shaft 60 and shaft engagement means 68 or mechanisms 68 may be used including but not limited to one or more detent balls, non-circular shafts, removable handles on non-circular shafts etc. This patent application is not limited to the depictions shown or described.

The design also features apparatus for collecting urine within a fluid collection container or receptacle 5 or appropriate plumbing for separate storage or treatment. Such apparatus is located below the urine aperture 1.2.1 in the upper section 1. If the solids collection container 3 is located toward the back end 14 of the body 10 and the handle is advantageously located at the front end 12 of the body 10 the agitator drive mechanism 40 may pass through the area occupied by the fluids. In such cases the fluids receptacle 5 may include a drive shaft clearance slot or aperture 24 to allow removal for the fluids collection container without interference with the drive shaft 60 whilst maintaining sufficient capacity for collected fluids.

The interface between the urine aperture and urine container 5 or plumbing apparatus may feature a valve 7 that can be operated by the user. Appropriate valve types include but are not limited to ball valves or butterfly valves. Such a valve can also obstruct the odour of urine that is hydrolysed and contains high levels of ammonia from passing back to the user. Additionally, it would help obstruct the flow of urine out of a urine container 5 should the toilet be orientated at an angle, shaken or vibrated. Such situations may arise for portable toilets such as on a keeled-over boat or in an RV on a bumpy or uneven road. Indeed, the toilets on racing yachts have been known to feature seatbelts.

In the preferred embodiment depicted, the knob 6 that is used to operate the hook 8 to secure the upper and lower sections, also operates the valve 7.

In preferred embodiments the toilet also features a lid 9 to cover the entire toilet assembly, and to prevent objects entering the upper section 1 or lower section 2 through the urine aperture 1.2.1 or faecal aperture. The lid also provides additional obstruction for odours passing from the lower section 2 to the user through either apertures in the upper section 1.

For applications of portable toilets, it is advantageous for the lid 9 to be secured in the closed position. This can be achieved by means including but not limited to an appropriate clip, magnet, hook or eyes or any combination thereof. In a preferred embodiment, an eye 10.2 is attached to the lid 9 and protrudes through the top surface of the upper section. The eye could also constitute part of the lid itself. A hook 10.1 is permitted to rotate below the eye 10.2 and is automatically disengaged from the eye by a spring. In the preferred embodiment, when the hook 8 securing upper and lower sections is fully rotated it acts as a cam upon the hook 10.1 such that it too engages the eye 10.2 securing the lid also.

An additional element of composting toilets is ensuring sufficient ventilation to minimise odours and facilitate drying of materials. This is typically done by means of one or more fans to provide a fresh supply of oxygen. The fans 17 may be orientated to maximise air circulation over the solids, or to force air out of the solids chamber and through a ventilation pipe to carry away unwanted odours. In addition an air filter 11 containing a suitable filtration medium may be introduced to neutralise odours and reduce the need for external ventilation pipes 20. External air vents 20 can be covered with suitable covers 11.1 to prevent contact with the internal fans 17 and limit access by insects.

In use the composting toilet 100 may be installed in any location but is most suited to portable situations where space is at a premium. The user lifts the lid 9 and sits on the seat 1.4 when making a deposit. If included they will need to open the rotating discs 1.3 using the knob 1.5.1. The urine aperture 1.2 will receive any urine and direct it to the urine receptacle 5 or drainage pathway. The solids collection container 3 will receive any faecal matter deposited.

Once the user has finished they may close the lid 9 and the rotating discs 1.3 if included to contain the waste and reduce odour. The user may then choose to move the handle 50 from the stowed position 51 to the in use position 52. Once in the in use position 52 the user may rotate the handle 50 which will rotate the agitator drive shaft 60. The drive shaft 60 will engage the agitator 30 via the agitator engagement means 42 and thus rotate the agitator 30 in order to agitate the contents of the solids collection container 3. This will introduce further oxygen to the collected solids and promote aerobic decomposition. The handle 50 and agitator drive mechanism 40 is then returned to the stowed position 51.

At a point thereafter most likely after a plurality of further deposits have been made, the user may choose to empty the composting toilet 100. Emptying the fluids receptacle 3, if fitted, is achieved by simply opening the top section 1 of the body 10 and lifting out said fluids receptacle 3 for disposal of the collected fluids. The drive shaft clearance slot 24 allowing the fluids receptacle 3 to be removed freely. The engagement means 40 will be engaged when the solids collection chamber 3 is installed. With the handle in the stowed position 51 the shaft drive surfaces 44 will be aligned by the drive mechanism alignment means 82 and therefore the agitator drive faces 34 will also be in alignment allowing the solids collection chamber 3 to be removed using handle 3.1. The chamber 3 can then simply be inverted above a suitable disposal location whilst being held by recesses, handles or grips 3.3 to allow any collected and now decomposed faeces to drop out of the solids collection container 3. Once empty the agitator 30 is free to rotate, the centre of gravity G will rest below the axis X causing the agitator drive surfaces 34 to align with the shaft drive surfaces 44 when the solids collection container 3 is installed in the direction M. The upper section 1 of the toilet 100 may then be closed and the cycle repeated.

The terminology used herein is used for the purpose of describing particular embodiments only and is not intended to be limiting to the invention. As used herein "and/or"

includes any and all combinations of one or more of the associated listed items. As used herein the singular forms "a", "an" and "the" are intended to include the plural forms unless the context clearly indicates otherwise. It will be further understood that the terms "comprises" and/or "comprising", when used in this specification, specify the presence of stated features, steps, operations, elements and/or components, but do not preclude the addition of one or more other features, steps, operations, elements and/or components or groups thereof.

The present disclosure is intended to be an exemplification of the invention and is not intended to limit the invention to the specific embodiments illustrated by the figures or the description below.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

Any system feature as described herein may also be provided as a method feature, and vice versa. As used herein, means plus function features may be expressed alternatively in terms of their corresponding structure.

Any feature in one aspect may be applied to other aspects, in any appropriate combination. In particular, method aspects may be applied to system aspects, and vice versa. Furthermore, any, some and/or all features in one aspect can be applied to any, some and/or all features in any other aspect, in any appropriate combination.

It should also be appreciated that particular combinations of the various features described and defined in any aspects can be implemented and/or supplied and/or used independently.

The invention claimed is:

1. A composting toilet including:

a body, a solids collection chamber for receiving faecal matter, and an agitator for moving faecal matter within the solids collection chamber; the agitator rotatably mounted in the solids collection chamber and rotatable about an axis X, and an agitator drive mechanism for driving the agitator;

wherein the agitator drive mechanism comprises a handle, an extendable drive shaft having a first end and a second end, the first end connected to the handle and the second end is connected to the agitator; and the handle and the extendable drive shaft are moveable from a first stowed position to a second in-use position for driving rotation of the agitator.

2. The composting toilet of claim 1 wherein the extendable drive shaft comprises an inner shaft connected to the handle, slidably engaged in an outer shaft connected to the agitator and a shaft engagement means for transmitting rotation from the inner shaft to the outer shaft.

3. The composting toilet of claim 2 wherein the shaft engagement means comprises a longitudinal slot in the outer shaft, and a pin extending through said slot and secured to the inner shaft, or the shaft engagement means comprising inner shaft and outer shaft having a non-circular complementary cross-section, or a detent ball.

4. The composting toilet of claim 1 wherein the solids collection chamber is a removable solids collection chamber and the agitator drive mechanism comprises an agitator engagement means for engagement and disengagement of the agitator from the agitator drive mechanism when the solids collection container is removed.

5. The composting toilet of claim 4 wherein the agitator engagement means includes one or more shaft drive surfaces on the drive shaft for engaging one or more agitator drive surfaces on the agitator.

6. The composting toilet of claim 5 wherein the one more shaft drive surfaces of the engagement means include a radially extending tongue fixed to the drive shaft and the one or more agitator drive surfaces comprise a slotted disc attached to the agitator defining an elongate slot and wherein, the tongue engages the slotted disc when the solids collection chamber is installed in the body.

7. The composting toilet of claim 4 wherein the agitator drive mechanism includes an alignment means for aligning the one or more agitator drive surfaces and the one or more shaft drive surfaces to allow engagement and disengagement of the engagement means on fitting and removal of the solids collection chamber.

8. The composting toilet of claim 7 wherein the alignment means includes a drive mechanism alignment means, comprising the agitator drive mechanism with one or more handle aligning surfaces and the body including one or more complementary body aligning surfaces for receiving the handle in one or more aligned positions when in the first stowed position.

9. The composting toilet of claim 8 wherein the handle aligning surfaces are on the handle and the one or more complementary body aligning surfaces comprise a recess for receiving the handle when in the first stowed position.

10. The composting toilet according to claim 1 wherein the body includes a front end toward which urine is received and a back end toward which faecal matter is received and wherein the handle is located at the front end of the body.

11. The composting toilet of claim 7 wherein the alignment means includes an agitator alignment means.

12. The composting toilet of claim 11, wherein an agitator alignment means comprises the agitator having a centre of gravity G displaced radially from axis X, and wherein the one or more agitator drive surfaces are orientated to engage with the shaft drive surfaces when the centre of gravity G is below the axis X at the point of engagement.

13. The composting toilet of claim 11 wherein the elongate slot of the slotted disc is parallel to a line extending between axis X and the centre of gravity G of the agitator.

14. The composting toilet of claim 10 wherein the body includes a first drive shaft support at the front end for supporting the first end of the extendable drive shaft and a second drive shaft support proximal the solids collection chamber within the body and wherein the first end is rotatably mounted within said first drive shaft support and the second end of the extendable drive shaft is rotatably mounted in the second drive shaft support.

15. The composting toilet of claim 1 including a removable fluids receptacle for receiving urine, within said body and said fluids receptacle including a drive shaft clearance slot for allowing easy removal of the fluid collection container.

16. The composting toilet of claim 1 wherein the agitator includes one or more tines extending radially from axis X in an arc of angle $\alpha$ less than 180 degrees from axis X and optionally an arc less than 90 degrees from axis X for providing clearance to a user when the composting toilet is in use.

17. The composting toilet of claim 1 including one or more fans for moving oxygenated air around the faecal matter within the solids collection container.

18. The composting toilet of claim 17 including an aperture in the body fluidly connected to the one or more fans.

19. The composting toilet of claim 18 wherein the aperture includes an air filter wherein said air filter is an odour reducing filter.

20. The composting toilet of claim 1 wherein the solids collection chamber has an open top and a closed bottom for containing faecal matter and handles, indentations or grips in the bottom half so as to facilitate easier emptying of the chamber when inverted.

* * * * *